US010012101B2

(12) United States Patent
Simon-Delgado et al.

(10) Patent No.: US 10,012,101 B2
(45) Date of Patent: Jul. 3, 2018

(54) SEAL SYSTEM FOR A GAS TURBINE

(71) Applicant: ANSALDO ENERGIA IP UK LIMITED, London (GB)

(72) Inventors: Carlos Simon-Delgado, Baden (CH); Christoph Didion, Wettingen (CH); Marc Widmer, Winterthur (CH); Martin Schaefer, Hunzenschwil (CH); Guenter Filkorn, Nussbaumen (CH)

(73) Assignee: ANSALDO ENERGIA IP UK LIMITED, London (GB)

( * ) Notice: Subject to any disclaimer, the term of this patent is extended or adjusted under 35 U.S.C. 154(b) by 624 days.

(21) Appl. No.: 14/574,846

(22) Filed: Dec. 18, 2014

(65) Prior Publication Data

US 2015/0176424 A1 Jun. 25, 2015

(30) Foreign Application Priority Data

Dec. 20, 2013 (EP) ..... 13198715

(51) Int. Cl.

| | |
|---|---|
| ***F01D 11/18*** | (2006.01) |
| ***F01D 11/00*** | (2006.01) |
| ***F01D 11/02*** | (2006.01) |
| ***F01D 11/12*** | (2006.01) |

(52) U.S. Cl.

CPC ..... *F01D 11/18* (2013.01); *F01D 11/001* (2013.01); *F01D 11/025* (2013.01); *F01D 11/122* (2013.01); *F01D 11/127* (2013.01); *F05D 2250/283* (2013.01)

(58) Field of Classification Search

CPC ..... F01D 11/18; F01D 11/001; F01D 11/025; F01D 11/122; F01D 11/127; F05D 2250/283

USPC ..... 415/174.5, 173.1, 174.4; 60/799

See application file for complete search history.

(56) References Cited

U.S. PATENT DOCUMENTS

| | | | | |
|---|---|---|---|---|
| 3,262,635 | A * | 7/1966 | Smuland | F01D 11/02 277/414 |
| 3,314,651 | A * | 4/1967 | Beale | A61K 8/4913 415/173.6 |
| 3,606,349 | A * | 9/1971 | Petrie et al. | F16J 15/48 277/414 |
| 3,782,735 | A * | 1/1974 | Novosad | F16J 15/3496 277/360 |
| 4,257,735 | A * | 3/1981 | Bradley | B22F 3/002 277/303 |

(Continued)

FOREIGN PATENT DOCUMENTS

FR 2 977 274 A1 1/2013

*Primary Examiner* — Jason T Newton

(74) *Attorney, Agent, or Firm* — Buchanan Ingersoll & Rooney PC

(57) ABSTRACT

The invention pertains to a seal system for a passage between a turbine stator and a turbine rotor, including: a first arm extending radially outwards from the turbine rotor and toward the first seal arranged on the stator, and terminating short of the first seal thereby creating a first gap between the first seal and the first arm. The seal system further includes a second seal arranged on the turbine stator, and a second arm extending axially from the turbine rotor towards the second seal base, and terminating short of the second seal thereby creating a second gap between the second seal and the second arm. The invention further refers to a gas turbine including such a seal system.

12 Claims, 3 Drawing Sheets

(56) References Cited

U.S. PATENT DOCUMENTS

| | | | | |
|---|---|---|---|---|
| 4,309,145 | A * | 1/1982 | Viola | F01D 11/025 415/173.7 |
| 7,500,824 | B2 * | 3/2009 | Cheng | F01D 11/02 415/173.4 |
| 8,172,514 | B2 * | 5/2012 | Durocher | F01D 11/001 415/136 |
| 9,617,867 | B2 * | 4/2017 | Maekawa | F01D 11/001 |
| 2008/0056889 | A1 * | 3/2008 | Cheng | F01D 11/001 415/174.4 |
| 2009/0014964 | A1 | 1/2009 | Pu et al. | |
| 2010/0074734 | A1 * | 3/2010 | Little | F01D 11/001 415/173.7 |
| 2010/0254806 | A1 * | 10/2010 | Deodhar | F01D 11/001 415/173.7 |
| 2013/0189073 | A1 * | 7/2013 | Adaickalasamy | F01D 11/122 415/1 |
| 2015/0330242 | A1 * | 11/2015 | Li | F01D 1/02 415/173.1 |
| 2015/0354391 | A1 * | 12/2015 | Li | F01D 11/001 415/173.1 |

* cited by examiner

SEAL SYSTEM FOR A GAS TURBINE

CROSS-REFERENCE TO RELATED APPLICATIONS

This application claims priority to European application 13198715.8 filed Dec. 20, 2013, the contents of which are hereby incorporated in its entirety.

TECHNICAL FIELD

The present disclosure relates to rim seal positioned in an annular space between rotating blades and a non-rotating adjacent structure in a gas turbine. Further, it relates to a gas turbine comprising the seal system.

BACKGROUND

Gas turbines typically include a plurality of rows of stationary turbine vanes extending radially inward from a casing forming a stator and a plurality of rows of rotatable turbine blades attached to a rotor assembly that rotates relative to the turbine stator. Typically, a turbine rim seal seals the gaps between the turbine stators and turbine rotors to minimize the loss of cooling air from the rotor assembly and hot gas ingestion into a gap or space between the turbine stators and turbine rotors.

During operation from a start up to steady state load operation the position of the rotating turbine rotor relative to the turbine stator changes due to different thermal expansion of the different components and centrifugal forces acting on the rotor. The resulting relative displacement depends on the location of a part on the rotor, respectively on the stator. Consequently, the position of sealing surfaces of a rim seal, respectively a gap of a rim seal changes during the operation of a gas turbine. As a result the leakage of a seal can change during operation. An increase in leakage reduces the gas turbine performance; in particular the power and efficiency can be reduced, and a leakage can have detrimental effect on the gas turbine's emissions. A reduction in the gap width can lead to rubbing between rotor and stator parts and can damage the gas turbine.

From the US2009/0014964 a seal system for an intersection between a turbine stator and a turbine rotor to seal cooling fluids is known. This seal system is formed from a seal base extending from the turbine stator, an arm extending radially outward from the turbine rotor and toward the seal base but terminating short of the seal base thereby creating a gap between the seal base and the arm. The seal system further includes a honeycomb shaped seal attached to the seal base and extending radially inward from the seal base toward the arm wherein the outer sealing surface is nonparallel with a longitudinal axis about which the turbine rotor rotates thereby reducing the distance of the gap with axial movement of the turbine rotor.

SUMMARY

An object of the present disclosure is to propose seal system for a gas turbine, which minimizes leakage during transient and steady state operation and avoids dangerous rubbing for all operating conditions. Further, the disclosed seal system has a robust design with low complexity, which requires only small modifications over existing solutions.

According to a first embodiment the seal system for a gap or passage between a turbine stator and a turbine rotor comprises a first seal base facing radially inwards from the turbine stator, a first seal attached to the first seal base and extending radially inwards from the first seal base, and a first arm (also called fin) extending radially outwards from the turbine rotor and toward the first seal. The first arm terminates short of the first seal and thereby creating a first gap between the first seal and the first arm. The seal system further comprises a second seal base facing in axial direction from the turbine stator, a second seal attached to the second seal base and extending axially from the second seal base towards the rotor, and a second arm (also called fin) extending axially from the turbine rotor towards the second seal base. The second arm is terminating short of the second seal thereby creating a second gap between the second seal and the second arm. The seals and arms typically extend around the circumference to the rotor, respectively the stator.

According to one embodiment the first arm, the second arm, and the surface of the turbine stator section facing the first arm and surface of the turbine stator section facing the second arm delimit an outer cavity. The outer cavity is separated from the remaining annular cavity by the second arm and second seal.

This outer cavity can for example have the shape of a ring arranged below a vane platform.

The outer cavity serves as an additional cavity between rotor and non-rotating parts close to the rim of the rotor for leakage reduction. It can also dampen or prevent hot gas ingestion into cooled section of the rotor damping. In particular it helps to mitigate the heat pick up of the rotor due to a high temperature leakage into the sealing system.

In a further embodiment of the seal system the turbine stator section facing the outer cavity comprises two components. Between the two components a seal or slot having a predetermined leakage rate for purging the outer cavity can be arranged. Upstream of the seal or gap a plenum with pressurized warm air can be arranged.

The two components can for example be a row of turbine vanes and a rotor cover separating an upstream plenum from the outer cavity and the annular gap between the stator and the first rotor.

According to one embodiment the first seal and/or the second seal can be made of a honeycomb material. Alternatively or in combination the first seal and/or the second seal can be made of an abradable material.

The first arm has a radial extension to seal against the first seal. However, depending on the size of an overhang (typically part of the vane platform) of the stator towards the rotor the first arm can also have an axial extension towards the stator to bridge at least part of the distance between the rotor and stator. To allow easy assembly and disassembly the second arm can extend further in axial direction towards the turbine stator than the first arm.

According to a further embodiment the seal system comprises a locking plate attached to a row of rotating blades and the first arm and/or the second arm extends from the locking plate.

The first arm and/or the second arm can also extend from a row of rotating blades, which delimit the seal system on the side of the turbine rotor. Integrating the arms into a row of rotating blades reduces the number of parts and avoids additional fixations and interfaces. However, the use of a locking plate can simplify the production of the blades. In particular the casting of the second arm which might extend far in axial direction increases the required size of the casting mold and complicates the casting process. The locking plate can further serve to reduce leakage of cooling air from the spaces between neighboring blades into the passages of the seal system.

Specifically the first seal base can be on the side of platform of a turbine vane facing away from a hot gas path of the turbine. The platform surface itself can be the seal base. Depending on the stator material the stator itself can serve as seal and seal base integrated into the stator part.

Besides the sealing system a gas turbine comprising such a sealing system is an object of the disclosure. Such a gas turbine has a compressor, a combustion chamber, a turbine, a turbine stator and a rotor. Further, the gas turbine comprises a seal system as described above for sealing a passage between a turbine stator and a turbine rotor of that gas turbine.

According to one embodiment the gas turbine comprises an annular cavity extending radially inwards between turbine stator and a turbine rotor the below the second arm and that it comprises a purge air supply into the annular cavity.

During operation from a start up to steady state load operation, and steady state base load operation the position of the rotating turbine rotor relative to the turbine stator changes. The resulting relative displacement depends on the location of a part on the rotor, respectively on the stator. To assure a good sealing performance of the sealing system during all operating conditions and to assure mechanical integrity of the system such relative displacements have to be considered in the design of a gas turbine with such a seal system.

A gas turbine is assembled at cold condition, i.e. stator and rotor practically have ambient temperature, respectively the temperature of a factory hall, and initial cold clearances are determined during assembly. At warm operating conditions at steady state, in particular at base load or full load the stator and rotor are heated relative to the cold conditions. Since stator and rotor are typically made of different materials with different thermal expansion coefficients, have differend geometries and masses, and because the parts are heated to different temperatures during operation the clearances change during operation. Further changes occur after operation of the gas turbine, when it cools down back to cold conditions. The difference in thermal expansion has to be considered and can be influenced during the design of the gas turbine.

According to an embodiment the gas turbine's stator and rotor are designed to have a difference in thermal expansion such that the first gap provided between the first arm and the first seal closes during operation relative to the first gap at cold condition of the gas turbine. This can for example be realized with a ring section in structure supporting the seal which is locally cooled to reduce its thermal expansion or which is made of a material with a thermal expansion coefficient smaller than the thermal expansion coefficient of the rotor section at the seal system.

In combination or as alternative the stator and rotor can be designed to have a difference in thermal expansion such that the second gap provided between the second arm and the second seal closes during operation relative the second gap in cold condition. This can be realized for example by designing a turbine with a cooling which leads to a higher average temperature increase in the stator section than in the rotor section between the axial position of the sealing system and an common upstream fix point. The common upstream fix point can for example be an axial bearing.

In another embodiment of the gas turbine the stator and rotor are designed to have a difference in thermal expansion such that the second gap closes to a minimum gap or that the second arm rubs into the second seal due to a faster thermal expansion of the stator relative to the thermal expansion of the rotor during transient warm up and opens to a gap wider than the minimum gap during steady state operation of the gas turbine. To realize such a difference in thermal expansion the gas turbine can for example be designed such that the specific heat transfer to the rotor section between the axial position of the sealing system and an common upstream fix point is smaller than the specific heat transfer to the stator between the axial position of the sealing system and an common upstream fix point; where the specific heat transfer is the heat transfer rate to the component divided by the heat capacity of the component.

In yet another embodiment of the gas turbine the stator and the turbine rotor are designed to have a difference in thermal expansion such that the first gap opens to a maximum gap due to a faster thermal expansion of the stator relative to the thermal expansion of the rotor during transient warm up and closes to a gap smaller than the maximum gap during steady state operation of the gas turbine. To realize such a difference in thermal expansion gas turbine can for example be designed such that the specific heat transfer to the rotor section between the axial position of the sealing system and an common upstream fix point is smaller than the specific heat transfer to the stator between the axial position of the sealing system and a common upstream fix point; where the specific heat transfer is the heat transfer to the component divided by the heat capacity of the component.

In a further embodiment of the gas turbine the stator and the rotor are designed to have a difference in thermal expansion such that first gap closes to a minimum gap or to rub into the first seal due to a faster thermal contraction of the stator relative to the thermal contraction of the rotor during transient cool down. In addition or alternatively the stator and the rotor are designed to have a difference in thermal expansion such that the second gap opens to a maximum gap due to a faster thermal contraction of the stator relative to the thermal contraction of the rotor during transient cool down of the gas turbine.

In addition, in the design of the seal system the influence of centrifugal forces on the gap between sealing arm and seal can be considered. These can be especially of importance for the first seal.

Due to the arrangement of two subsequent seals which are anti-cyclic in their transient behavior, i.e. when the gap of the first seal opens the gap of the second seal closes and vice versa, a good sealing of the annular gap to the hot gas path can be assured during all operating conditions.

The disclosed seal system has a low level of geometrical impact on the gas turbine design due to its compact design. The required parts have low complexity. Blade and vane overhang respectively sealing arms remain short. No overhangs in structural parts are required. Further, there is no need to provide additional space for vane geometry design.

The sealing system allows good maintenance of the gas turbine due to improved accessibility. A vertical assembly/disassembly of structural parts is possible. Also reconditioning of structural parts and blades is easy due to low complexity level of their design (e.g. the simple vertical honeycomb arrangement). The blades can be accessible after disassembly of vanes without a need of further removal of stator parts.

The upper seal, i.e. the seal between first arm and first seal determines the overall seal performance and total leakage flow to hot gas flow path. The lower seal, i.e. the seal between the second arm and second seal defines and reduced the leakage from the annular cavity. It provides cooled air to the ring cavity and stops any back flow to the annular cavity.

The ring cavity serves as buffer cavity. It protects the rotor and stator from hot gas ingestion. If hot gas enters into the ring cavity, it stays there because of the flow across the inner seal (formed by the second arm and second seal). Further it prevents the backflow of internal leakages, e.g. from a plenum with pressurized warm air, into the annular cavity. Typically secondary circulation flows occur in an annular cavity which transports air from a radial outer position to an inner diameter of the annular cavity. If warm air enters the annular cavity at a location close to the hot gas flow this can lead to local overheating of the inner rotor surfaces.

All the advantages explained can be used not only in the combinations specified in each case, but also in other combinations or alone, without departing from the scope of the invention. The can be for example applied to single combustion as well as to sequential combustion gas turbines.

BRIEF DESCRIPTION OF THE DRAWINGS

The disclosure, its nature as well as its advantages, shall be described in more detail below with the aid of the accompanying drawings. Referring to the drawings.

DETAILED DESCRIPTION

Figure 1:
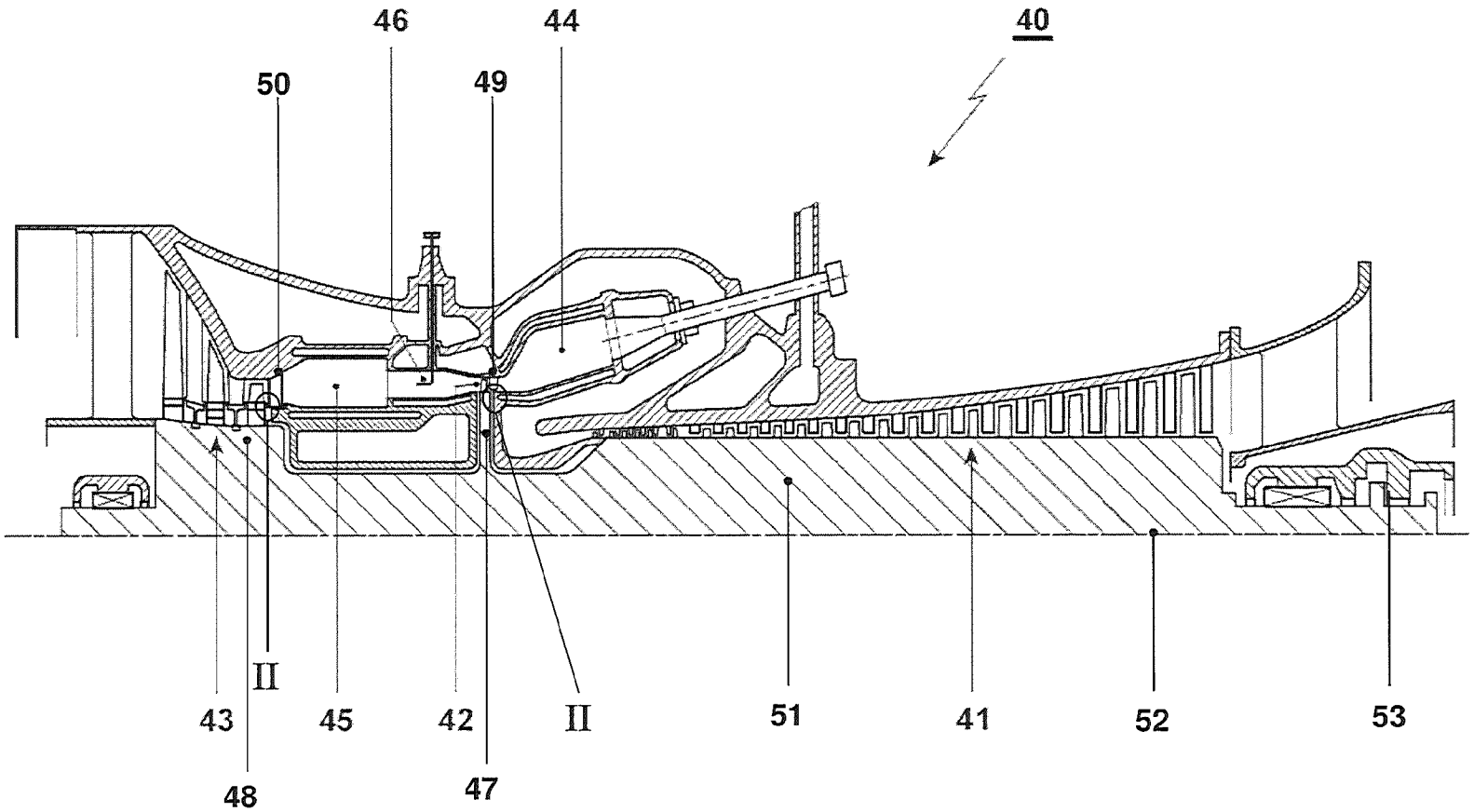
FIG. 1 schematically shows a cross section of a gas turbine with the disclosed sealing system.

FIG. 1 shows a schematic illustration of the main elements of a gas turbine power plant according to an exemplary embodiment. The gas turbine 40 extends along a machine axis 52 and comprises a compressor 41, which inducts and compresses combustion air during operation, a subsequent first combustion chamber 44, a first turbine also called high pressure turbine 42 which is arranged downstream of the first combustion chamber 44, a second combustion chamber 45, and a second turbine also called low pressure turbine 43 which is arranged downstream of the second combustion chamber 45. The exhaust gas which discharges from the second turbine 45 leaves the turbine. The useful energy generated in the gas turbine 40 can be converted into electrical energy, for example, by means of a generator (not illustrated) arranged on the same shaft.

The hot exhaust gas emerging from the turbine 43 can be conducted through an exhaust gas line for the optimal utilization of the energy still contained in them to a HRSG (Heat Recovery Steam Generator) or to waste heat boiler, and is used for generating live steam for a steam turbine (not illustrated) or for other plants.

The axial position of the rotor 51 relative to the stator 49, 50 is determined by the axial bearing 53 as a fix point. The rotor 51 comprises a high pressure turbine rotor 47 enclosed by a high pressure turbine stator 49 and a low pressure turbine rotor 48 enclosed by a low pressure turbine stator 50. A seal system II is arranged at the interface between the high pressure turbine rotor 47 and high pressure turbine stator 49 as well as between the low pressure turbine rotor 48 and the low pressure turbine stator 50.

Figure 2A:
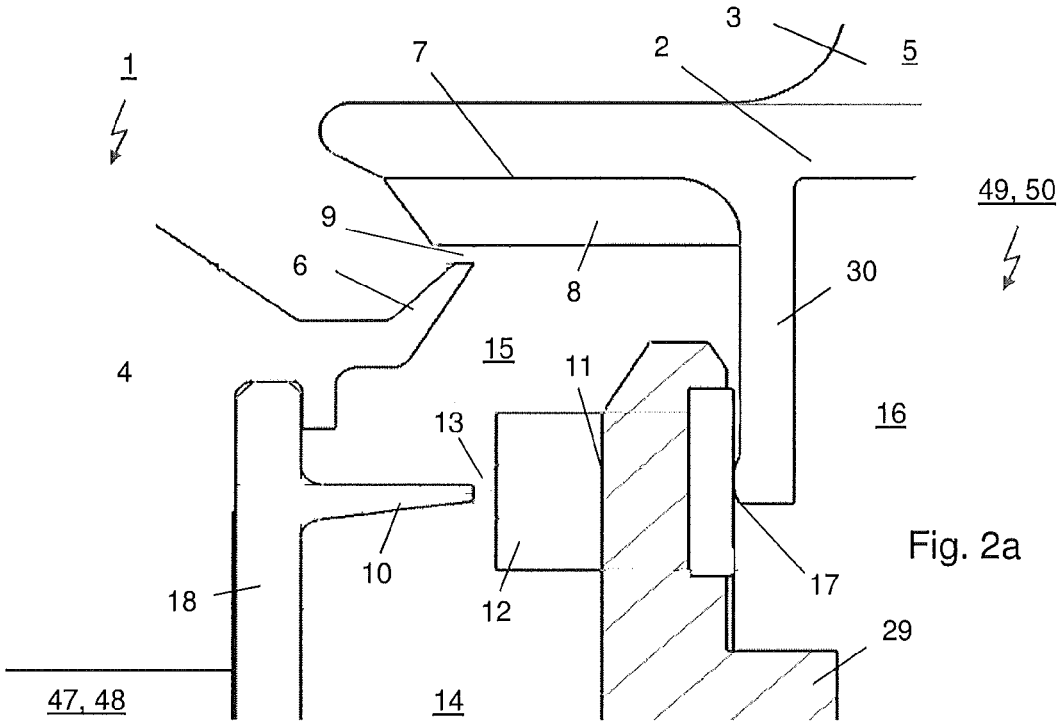
FIG. 2*a* shows a cut out of a turbine with a side view of the sealing system in cold conditions of the gas turbine.

The seal system II is schematically shown in more detail as a cut out of the gas turbine 40 in FIG. 2. The seal system is shown for cold conditions of the gas turbine 40 in FIG. 2*a*. The seal system II seals the rim of an annular cavity 14 extending between a turbine stator 49, 50 and a turbine rotor 47, 48. In the example shown the radially outer end of the turbine rotor is formed by the foot 4 of a turbine blade 1 attached to a rotor disk. The radially outer end of the turbine stator 49, 50 is formed by a vane foot 30 of a vane 5. The vane foot 30 can be connected to a rotor cover 29, which further delimits the annular cavity on the stator side. In the example shown, a seal 17 is arranged between the vane foot 30 and the rotor cover 29 which is overlapping with the vane foot 30 and extending radially inwards from the vane foot 30.

The vane 5 comprises a vane platform 2 attached to or integrated into the vane foot 30. The vane platform extends in axial direction to at least partly delimit the radial outer end of the annular cavity between the stator 49, 50 and the rotor 47, 48. The side of the vane platform 2 facing away from at the hot gas path of the turbine forms a first seal base 7. A first seal 8 extends from the first seal base 7 radially inwards.

From the rotor 47, 48, more specifically from the blade root 4 a first arm 6 extends radially in the direction of the first seal 8. The first arm 6 terminates short of the first seal 8 leaving a first gap 9 between the first seal 8 and the first arm 6.

Below the first arm 6 a locking plate 18 is attached to the blade foot 4 facing the annular cavity 14. The surface of the rotor cover 29 is configured to form a second seal base 11 on the surface facing the annular cavity 14 in the section axially opposite of the locking plate 18. A second seal 12 is attached to the second seal base 11 and extend in the direction of the annular cavity 14.

From the rotor 47, 48, more specifically from the locking plate 18, a second arm 10 extends in axial direction towards the second seal 12. The second arm 10 terminates short of the second seal 12 leaving a second gap 13 between the second seal 12 and the second arm 10.

The second seal 12 and second arm 10 separate an outer ring cavity 15 from the main annular cavity 14. The outer cavity is delimited in radial direction towards the axis of the gas turbine by the second seal 12 and second arm 10, in axial direction by the rotor cover 29 and vane foot 30 on the one side and the blade root 4 with locking plate 18 on the other side, and by the vane platform 2 in radial direction pointing away from the axis.

An airfoil 3 of the vane 5 extends from a vane platform 2 into the hot gas flow path of the turbine. A blade airfoil (not shown) extends from the blade root 4 respectively a blade platform (also not shown) into the hot gas flow path.

Figure 2B:
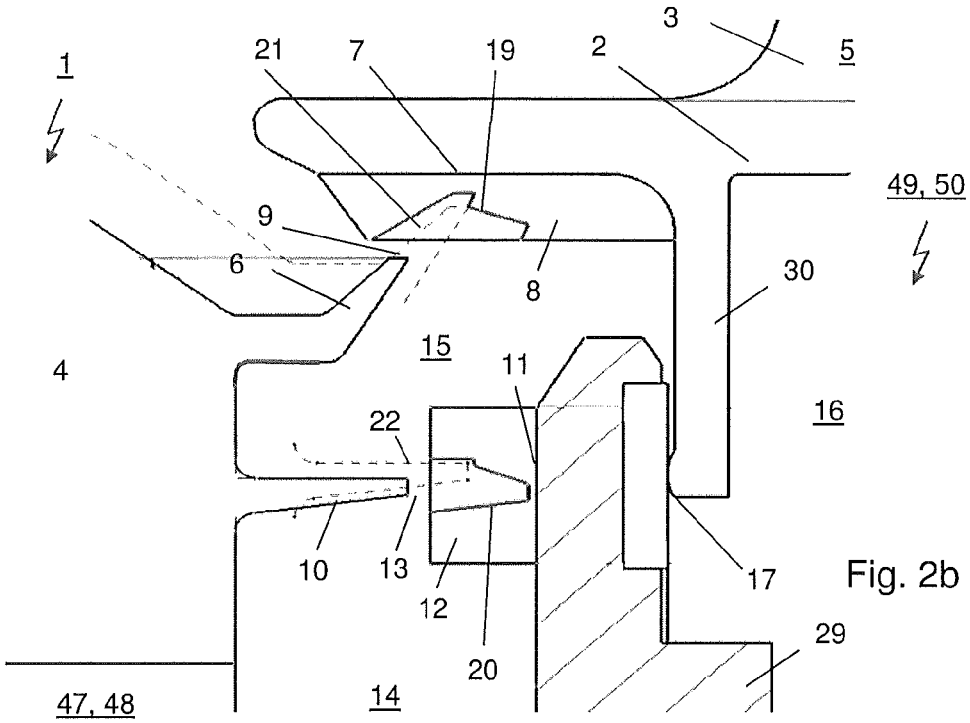
FIG. 2*b* shows the cut out of FIG. 2*a* with a slight modification and further indicating a possible rub in during transient operation of the gas turbine and further indicating the steady state location of sealing arms during warm steady state operating conditions of the gas turbine.

FIG. 2*b* shows another example based on FIG. 2*a*. In this example no locking plate 18 is arranged on the blade root and the second arm 10 extends from the blade root 4 into the annular cavity 14.

In addition a first seal cut out 19 and a second seal cut out 20, in the first, respectively second seal 8, 12 is indicated in the seals 8, 12. The seal cut out is due to transient movements of rotor 47, 48 relative to the stator 49, 50 during operation of the gas turbine.

Further, a first arm steady state position 21 and a second arm steady state position 22 are indicated as dotted line. The change of the arm positions 21, 22 is due to different thermal expansions from cold state to warm state.

Figure 2C:
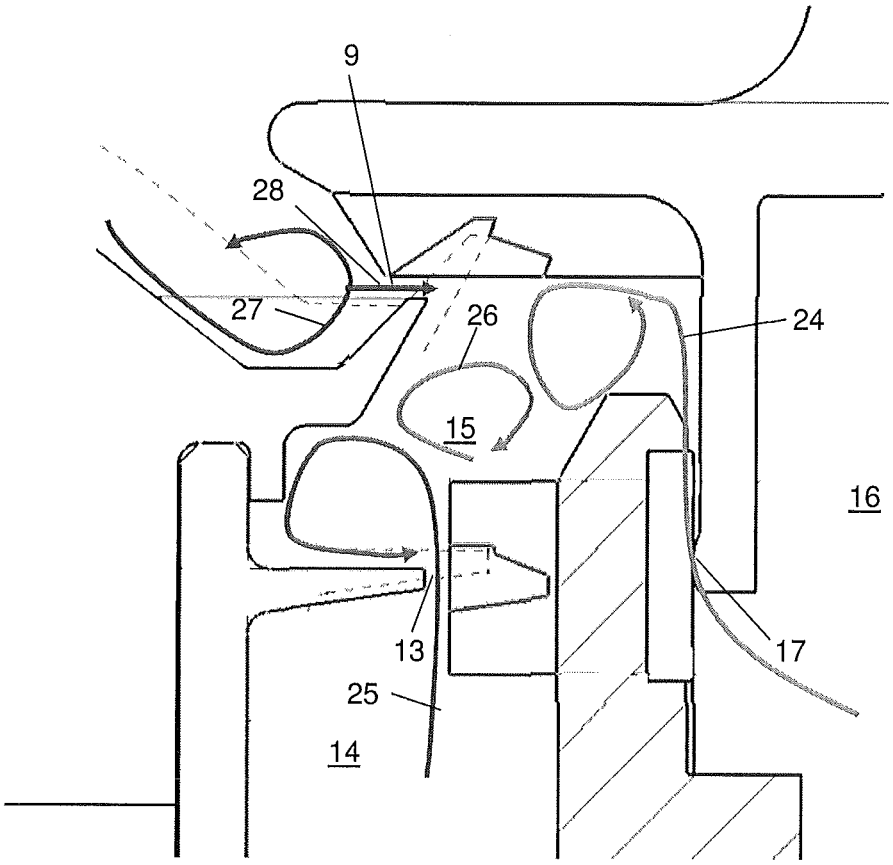
FIG. 2*c* shows the cooling and leakage flows of in the sealing system of 2*a* during operation.

FIG. 2*c* is based on FIG. 2*a*. The first seal cut out and a second seal cut out in the first, respectively second seal are indicated. Also a first arm steady state position and a second arm steady state position are indicated as dotted lines.

In addition the leakage and cooling air flows of the sealing system II are shown in FIG. 2*c*. Purge air 25 is introduced from the annular cavity 14 via the second gap 13 into to lower end of the ring cavity 15 where it forms a first vortex. A warm leakage 24 flows from the cooling cavity 16 through the stator seal 17 into the upper region of the ring cavity 15 forming a second vortex. Between the first vortex and the second vortex a mixing vortex 26 develops leading to moderate temperatures in all sections of the ring cavity 15. The mixing vortex also prevents local overheating due to possible hot gas ingestion 28 through the first gap of hot gas 27 from the hot gas flow at the upstream side of the blade.

All the explained advantages are not limited just to the specified combinations but can also be used in other combinations or alone without departing from the scope of the disclosure. Other possibilities are optionally conceivable, for example the first and/ or second arm can extend from the stator and one or both seals can be attached to the rotor. Further the rotor or stator surface itself can be used as seal. Further, for example sealing systems with multiple seals or multiple arms are conceivable, e.g. two first arms and/or two second arms arranged in series.

The invention claimed is:

1. A seal system for a passage between a turbine stator and a turbine rotor of a turbine, the seal system comprising:

a first seal base facing radially inwards from the turbine stator, a first seal attached to the first seal base and extending radially inwards from the first seal base, a first arm extending radially outwards from the turbine rotor and toward the first seal, and terminating short of the first seal thereby creating a first gap between the first seal and the first arm, a second seal base facing in an axial direction from the turbine stator, a second seal attached to the second seal base and extending axially from the second seal base towards the turbine rotor, a second arm extending axially from the turbine rotor towards the second seal base, and terminating short of the second seal thereby creating a second gap between the second seal and the second arm; and a locking plate attached to a row of rotating blades from which at least one of the first arm and the second arm extend.

2. The seal system according to claim 1, further comprising an outer cavity delimited by the first arm the second arm and surfaces of the turbine stator facing the first arm and second arm.

3. The seal system according to claim 2, wherein the turbine stator comprises two components facing the outer cavity with a seal or slot interposed, the seal or slot having a predetermined leakage rate for purging the outer cavity.

4. The seal system according to claim 1, wherein the first seal and/or the second seal is made of a honeycomb material or is made of an abradable material.

5. The seal system according to claim 1, wherein the second arm extends further in the axial direction towards the turbine stator than the first arm.

6. The seal system according to claim 1, wherein the first seal base is on a side of a platform of a turbine vane facing away from a hot gas path of the turbine.

7. A gas turbine comprising:

a compressor, a combustion chamber, a turbine stator, a turbine rotor, and a seal system including:

a first seal base facing inwards from the turbine stator, a first seal attached to the first seal base and extending radially inwards from the first seal base, a first arm extending radially outwards from the turbine rotor and toward the first seal, and terminating short of the first seal thereby creating a first gap between the first seal and the first arm, a second seal base facing in an axial direction from the turbine stator, a second seal attached to the second seal base and extending axially from the second seal base towards the turbine rotor, a second arm extending axially from the turbine rotor towards the second seal base, and terminating short of the second seal thereby creating a second gap between the second seal and the second arm; and a locking plate attached to a row of rotating blades from which at least one of the first arm and the second arm extend.

8. The gas turbine according to claim 7, further comprising an annular cavity extending radially inwards from the second arm between turbine stator and a turbine rotor, and in that it comprises a purge air supply into the annular cavity.

9. The gas turbine according to claim 7, wherein the turbine stator and the turbine rotor are designed to have a difference in thermal expansion such that the first gap provided between the first arm and the first seal closes during operation relative to the first gap at cold condition of the gas turbine, and/or that the turbine stator and the turbine rotor are designed to have a difference in thermal expansion such that the second gap provided between the second arm and the second seal closes during operation in cold conditions.

10. The gas turbine according to claim 7, wherein the turbine stator and the turbine rotor are designed to have a difference in thermal expansion such that the second gap closes to a minimum gap or to a point where the second arm extends into the second seal due to a faster thermal expansion of the turbine stator relative to the thermal expansion of the turbine rotor during transient warm up and opens to a gap wider than the minimum gap during steady state operation of the gas turbine.

11. The gas turbine according to claim 7, wherein the turbine stator and the turbine rotor are designed to have a difference in thermal expansion such that the first gap opens to a maximum gap due to a faster thermal expansion of the turbine stator relative to the thermal expansion of the turbine rotor during transient warm up and closes to a gap smaller than the maximum gap during steady state operation of the gas turbine.

12. The gas turbine according to claim 7, wherein the turbine stator and the turbine rotor are designed to have a difference in thermal expansion such that the first gap closes to a minimum gap or to a point where the first arm extends into the first seal due to a faster thermal contraction of the turbine stator relative to the thermal contraction of the turbine rotor during transient cool down, and/or in that the turbine stator and the turbine rotor are designed to have a difference in thermal expansion such that the second gap opens to a maximum gap due to a faster thermal contraction of the turbine stator relative to the thermal contraction of the turbine rotor during transient cool down of the gas turbine.

* * * * *